US005593460A

United States Patent [19]

Lessard

[11] Patent Number: 5,593,460

[45] Date of Patent: Jan. 14, 1997

[54] ARM EXTENDER TOOL

[76] Inventor: Wilfred E. Lessard, 203 Commonwealth Ave., New Britain, Conn. 06053

[21] Appl. No.: 349,443

[22] Filed: Dec. 5, 1994

Related U.S. Application Data

[63] Continuation-in-part of Ser. No. 953,895, Sep. 30, 1992, Pat. No. 5,402,550.

[51] Int. Cl.[6] ..... A47L 13/16

[52] U.S. Cl. ..... 15/143.1; 15/144.4; 15/244.2

[58] Field of Search ..... 15/105, 114, 143.1, 15/144.4, 145, 227, 236.02, 244.1, 244.2

[56] References Cited

U.S. PATENT DOCUMENTS

| | | | |
|---|---|---|---|
| 3,116,502 | 1/1964 | Gerber | 15/227 X |
| 3,407,424 | 10/1968 | Lanzarone et al. | 15/144.4 X |
| 3,491,397 | 1/1970 | Hesenor | 15/244.2 X |
| 4,099,289 | 7/1978 | Bretthauer | 15/244.1 X |
| 4,571,766 | 2/1986 | Goldman et al. | 15/244.1 X |
| 4,642,836 | 2/1987 | Bokmiller | 15/114 X |
| 4,813,458 | 3/1989 | Jacobucci | 15/236.02 |
| 4,962,561 | 10/1990 | Hamilton | 15/111 |

FOREIGN PATENT DOCUMENTS

| | | | |
|---|---|---|---|
| 187266 | 10/1956 | Austria | 15/244.1 |
| 907102 | 10/1962 | United Kingdom | 15/244.1 |

*Primary Examiner*—Chris K. Moore

[57] ABSTRACT

A tool for extending the effective reach of the user having a pair of spaced-apart curved extending members which are joined at the distal end by a connecting member. A work performing member such as a sponge is pivotally attached to the connecting member at a clip. A grip member having finger recesses is connected between the extending members at a predetermined distance from the proximal end of the extending members. A strap extends between the proximal end of the extending members to secure the arm extender to a person's forearm. The strap is secured to at least one of the extending members and wraps about the other extending member forming a loop therebetween whereupon the strap is attached onto itself. The user grips the gripping member with the user's hand and the user's forearm is secured within the loop of the strap. The strap is attached by, for example, a Velcro® type attachment. The extending, gripping and connecting members are preferably fabricated from a light weight plastic. The sections of the extending members in contact with the user's forearm may be padded.

10 Claims, 2 Drawing Sheets

10
12
14
16
20
24
26
38A
40
40A
40B
41
42
44
45
48
50
5
6
12,14

ARM EXTENDER TOOL

CROSS REFERENCE TO RELATED APPLICATION

This is a continuation-in-part of U.S. patent application Ser. No. 07/953,895, entitled "Arm Extender", filed Sep. 30, 1992 now U.S. Pat. No. 5,402,550, issued Apr. 14, 1995.

BACKGROUND OF THE INVENTION

The present invention relates to a tool for extending the effective reach of a person's arm. More particularly, the present invention relates to an arm extending tool having a removable work performing item such as a sponge disposed at one end thereof for performing tasks such as washing hard to reach areas of motor vehicles (e.g., sport utility vehicles, trucks, etc.).

Poles, rods and similar devices have been used to extend the reach of a person's arm for many purposes. However, poles, rods and similar devices tend to be difficult to control, particularly with longer lengths. Accordingly, there is a continuing need for devices which will extend the reach of a person's arm without sacrificing control. Reference is made to the following patents which disclose tools of various types having rods or grips to extend the reach of the user: U.S. Pat. Nos. 4,813,458; 4,099,289; 4,962,561; 3,407,424; 4,571,766; 4,642,836; 3,491,397; 3,116,502; U.K. Patent No. 907,102; and German Patent No. 187,266.

SUMMARY OF THE INVENTION

The above discussed and other problems and deficiencies of the prior art are overcome or alleviated by the arm extender of the present invention. In accordance with the present invention, the arm extender comprises a pair of spaced-apart curved extending arm members which are joined at their outer or distal end by a connecting member. A work performing item such as a sponge is adjustably and pivotally attached to the connecting member at a clip attached to the sponge. A grip is connected between the arm members a predetermined distance from the free or proximal ends of the extending arm members. Means for securing the arm extender to a person's arm is provided near the free or proximal end of the extending members. In a preferred embodiment, the securing means comprises an elastic band or strap. The strap is secured to at least one of the extending arm members and wraps about the other arm member forming a loop. During use, the user grips the grip with the user's hand and the user's forearm is secured within the loop of the strap. The loop of the strap may be secured by a loop and hook fabric fastener such as a Velcro® type attachment, snaps or any other well known fastener means. The extending arms, grip and connecting members are preferably fabricated from a light weight plastic. The gripping member and the portions of the extending arm members in contact with the user's forearm may be padded for comfort.

The arm extender tool of the present invention provides convenient access for washing of roof tops of motor vehicles (such as sport utility vehicles, trucks, etc.) which in the past have been difficult to reach.

The tool may also be useful in cleaning hard to reach areas in the home, such as cleaning around and behind toilets, floor areas, inside cabinets, ceiling fans and under objects such as radiators. Further, this device will aid persons that may have difficulty in bending or stooping to reach many of the aforementioned hard to reach areas.

BRIEF DESCRIPTION OF THE DRAWINGS

The above-discussed and other features and advantages of the present invention will be appreciated and understood by those skilled in the art from the following detailed description and drawings in which.

Referring now to the drawings wherein like elements are numbered alike in the several Figures.

DESCRIPTION OF THE PREFERRED EMBODIMENT

Figures 1, 2, 5, 6:
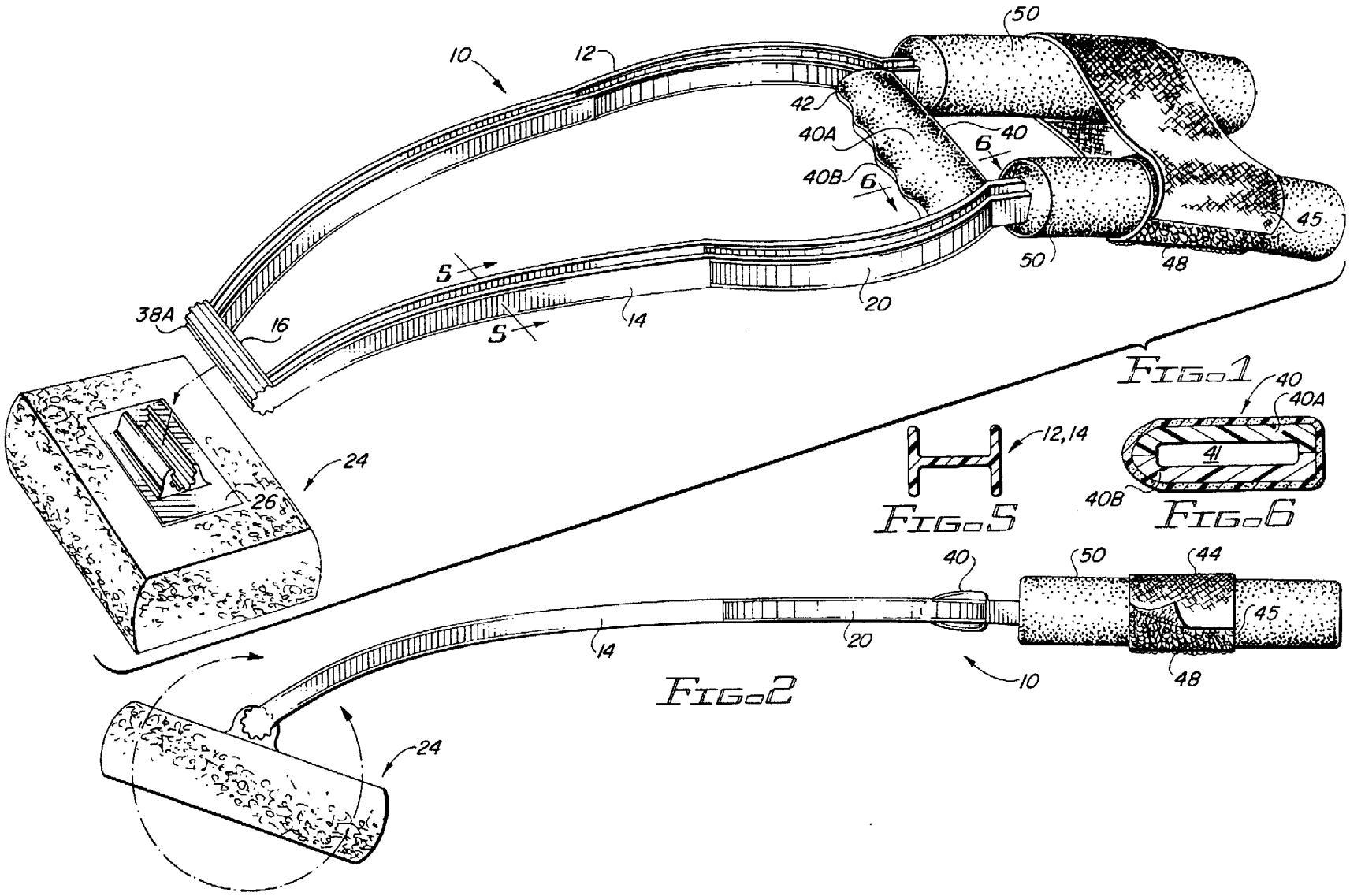
FIG. 1 is a perspective view of the arm extender in accordance with the present invention.
FIG. 2 is a side elevational view of the end of the extender with a sponge attached to the distal end thereof.
FIG. 5 is a cross sectional view of one of the arms as indicated by line 5—5 of FIG. 1.
FIG. 6 is a cross sectional view of the grip indicated by line 6—6 in FIG. 1.
Figure 3:
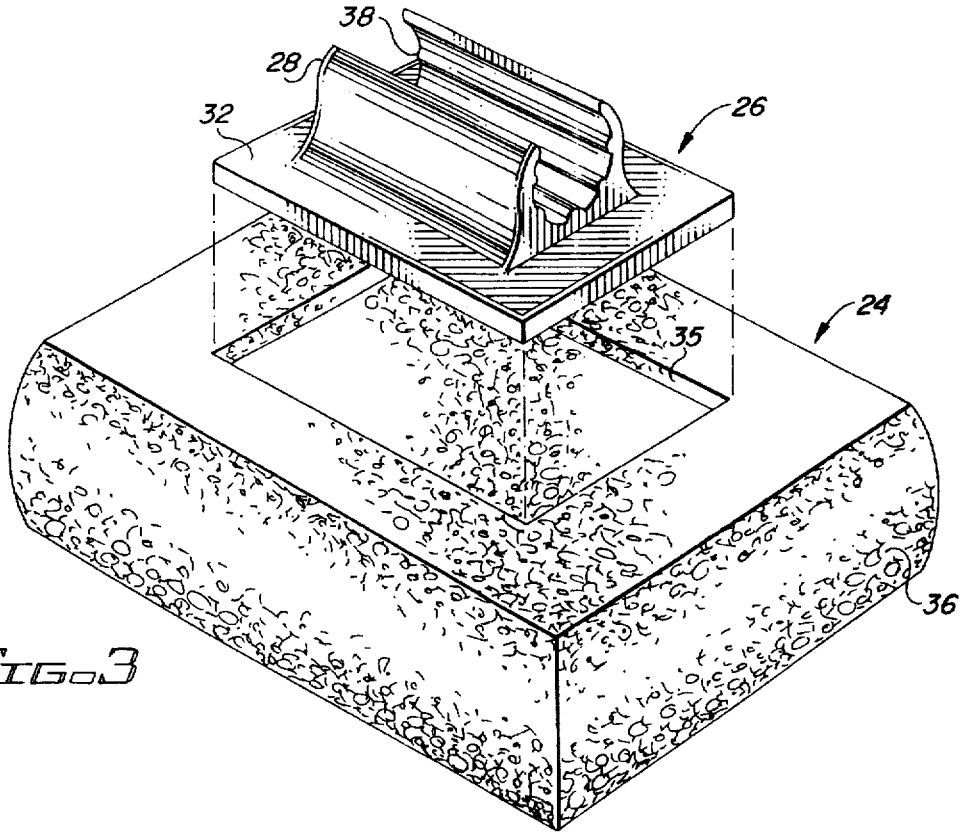
FIG. 3 is an exploded perspective view of the clip and sponge which are attachable at the end of the arm.

Referring to FIGS. 1 to 3, an arm extender tool is shown generally designated by the numeral 10 with a work performing item represented by a sponge unit 24 shown detached. Arm extender tool 10 comprises a pair of spaced, curved extending members 12 and 14 which are joined at the outer or distal end by a transverse connecting member 16. Each member 12 and 14 comprises a gradually forwardly and downwardly curving arcuate portion 18 extending from a proximal end of the member to the distal end. Arm members 12 and 14 may also have a slightly transverse curvature in an intermediate section of the arms designated by the numeral 20. Section 20 enlarges the opening between the arm for convenience and ease of operation and manipulation.

Members 12, 14 and 16 may be individual pieces connected by conventional means such as adhesive or other bonding techniques or may be a single continuous piece. Members 12, 14 and 16 are preferably comprised of a light weight, durable plastic such as ABS and the arms are preferably I-shaped in cross section for strength with a web and opposite flanges, as best seen in FIG. 5. The members 12 and 14 may also be other shapes such as tubular.

As seen in FIGS. 1 and 3, a sponge unit 24 is removably and pivotally disposed at connecting member 16 by mounting means 26. The mounting means 26, comprises a clip 28 pivotally disposed about connecting member 16. Clip 28 is connected to rectangular mounting plate 32. The plate and clip are preferably formed as a unit. Plate 32 is adhesively connected to sponge 36 at recess 35. The sponge 36 is either a natural or synthetic cellulose material which is quadrilateral and may have slightly rounded peripheral surfaces 34. The recess 35 is formed in the top surface. The clip and sponge comprise the sponge unit 24.

Sponge unit 24 and the attachment clip may be removed from the connecting member 16. Preferably, the interior of the clip 28 is provided with grooves 38 which cooperate with ribs 38A on member 16 to restrict the free rotation of the sponge unit. The user may adjust the sponge unit to the desired angularity by rotating the position of the clip relative to member 16 and then engaging the sponge unit.

A grip member 40 extends between members 12 and 14 intermediate the proximal ends and outwardly bowed section 20. Member 40 may be integrally formed with members 12 and 14, however, as seen in FIG. 6, member 40 may consist of similarly configured separate pieces 40A, 40B. As shown, member 40B is integrally molded in an assembly with arm members 12 and 14. Member 40A is then secured to member 40B with a hollow interior 41 therebetween for reduced material and weight. Member 40 is positioned at a location to be conveniently gripped by a user's hand so that a proximal section of each arm 12, 14 is positioned adjacent the user's forearm to provide support for the arm extender 10 during use. The forwardly disposed edge of grip 40 is provided with a plurality of arcuate recesses 42 which are configured to receive the fingers of the user.

Preferably, member 40 and a section of each of the arms 12, 14 extending from the proximal end to the grip are provided with padding 50 shown as an elastomeric foam such as foam rubber.

A stabilizing strap 44 is secured (e.g., sewn, ultrasonic weld, or loop/hook Velcro® type attachment) about at least one of members 12 and 14 at a location near the proximal end. During use, the free end 45 of strap 44 is wrapped over the user's forearm, around the outside of the opposite arm and under the user's forearm. The free end of the strap is attached to the secured end by fastener means. The fastener means may comprise a snap connector or preferably a loop and hook type attachment, such as Velcro®, whereby the secured end of strap 44 has a plurality of hooks in area 48 on the outwardly facing surface thereof and the free end 45 of strap 44 has a plurality of loops on the inwardly facing surface thereof for releasably engaging the hooks. While such attachment means are preferred, strap 44 may be a continuous elastic loop disposed about portions of members 12 and 14, whereby the user's forearm is secured within this loop between members 12 and 14 by the elastic characteristics of strap 44.

Figure 4:
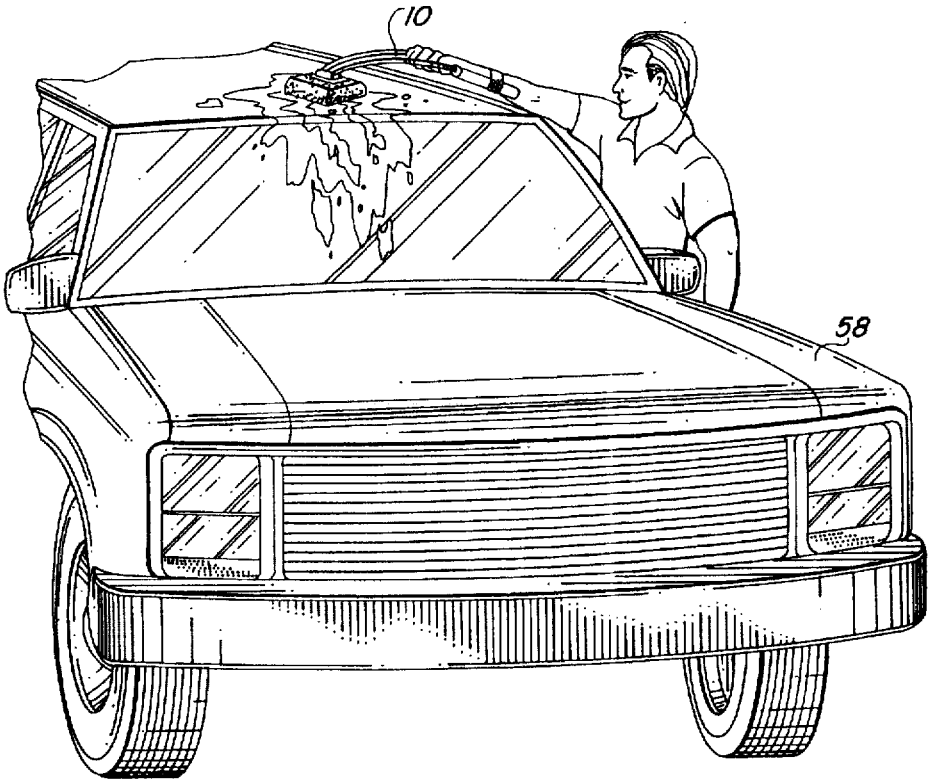
FIG. 4 is a perspective view of the arm extender of FIG. 1 being used to wash the roof of a sport utility vehicle.

Referring to FIG. 4 in which arm extender 10 is shown being used to wash the roof of a sport utility vehicle 58. Arm extender 10 is held by the user at gripping member 40 and retained by strap 44 extending over the user's forearm as previously described. The ease with which the user can now reach all areas of the roof of vehicle 58 is readily apparent by the illustration of FIG. 4. The sponge unit 24 can be adjusted to the desired angle at the C-clip. When the sponge is worn, it is easily replaced. It is contemplated the sponge will be offered to consumers in different sizes and configurations for different applications. Also, other working performing articles such as cleaning cloths, polishers, applicators and the like can be secured to the end of the extender tool.

While preferred embodiments have been shown and described, various modifications and substitutions may be made thereto without departing from the spirit and scope of the invention. Accordingly, it is to be understood that the present invention has been described by way of illustrations and not limitation.

I claim:

1. A manual arm extending device attachable to the forearm of a user comprising:

(a) a pair of extending arm members each having opposite first and second ends, each of said extending arm members being crowed along a substantial portion of its length between said opposite first and second ends, said first ends of each of said extending arm members being connected to define a connected end;

(b) a grip member connected between said extending members at a predetermined distance from said second ends of said extending arm members;

(c) a strap having an attachment member thereon, said strap having a length sufficient to permit said strap to be wrapped about both of said extending arm members with a user's forearm disposed therebetween, said attachment member being located between said grip member and the said second ends of said extending arm members, wherein said strap is attachable to itself by said attachment member; and (d) a work performing article having attachment means thereon removably disposed on said connected end.

2. The device of claim 1 wherein said connected end is tubular and said attachment means comprises a clip means.

3. The device of claim 2 further comprising a first pad disposed about said grip member and second and third pads disposed about each of said extending arm members respectively at a location between said grip member and said second ends of said extending arm members.

4. The device of claim 1 wherein said attachment member comprises:

a plurality of loops disposed on at least a portion of one surface of said strap at one end thereof; and a plurality of hooks on at least a portion of one surface of said strap at the other end thereof, whereby said loops and hooks engage to attach the strap onto itself.

5. The device of claim 1 wherein said strap is secured to at least one of said extending members.

6. The device of claim 1 wherein said extending arm members are comprised of a plastic member having a general I-shape cross section.

7. The device of claim 1 wherein said work performing article is a sponge unit.

8. The device of claim 7 wherein said sponge unit comprises a sponge and said attachment means comprises a generally C-shaped clip.

9. The device of claim 8 wherein said clip and connected end have inter-engaging surface means for restraining relative movement therebetween.

10. The device of claim 9 wherein said surface means comprises ribs and grooves.

* * * * *